United States Patent [19]

Bares

[11] Patent Number: 4,999,673

[45] Date of Patent: Mar. 12, 1991

[54] PROCESS CONTROL BY CREATING AND SENSING HALF-TONE TEST PATCHES

[75] Inventor: Jan Bares, Webster, N.Y.

[73] Assignee: Xerox Corporation, Stamford, Conn.

[21] Appl. No.: 349,734

[22] Filed: May 10, 1989

[51] Int. Cl.[5] ..... G03G 21/00

[52] U.S. Cl. ..... 355/208; 346/108; 355/246

[58] Field of Search ..... 355/204, 208, 246, 266, 355/239, 326, 327; 346/108, 160; 358/298

[56] References Cited

U.S. PATENT DOCUMENTS

| | | | |
|---|---|---|---|
| 4,560,997 | 12/1985 | Sato et al. | 346/140 |
| 4,604,654 | 8/1986 | Sakurada et al. | 358/298 |
| 4,662,313 | 5/1987 | Jeromin et al. | 118/691 |
| 4,693,592 | 9/1987 | Kurpan | 355/208 |
| 4,708,459 | 11/1987 | Cowan et al. | 355/208 X |
| 4,780,744 | 10/1988 | Porter et al. | 255/208 |
| 4,786,924 | 11/1988 | Folkins | 355/208 |
| 4,924,263 | 5/1990 | Bares | 355/208 X |

FOREIGN PATENT DOCUMENTS

| | | | |
|---|---|---|---|
| 0260072 | 12/1985 | Japan | 355/239 |
| 0025771 | 2/1987 | Japan | 355/239 |
| 1009022 | 11/1965 | United Kingdom | 355/239 |

*Primary Examiner*—A. T. Grimley
*Assistant Examiner*—J. E. Barlow, Jr.
*Attorney, Agent, or Firm*—H. Fleischer; J. E. Beck; R. Zibelli

[57] ABSTRACT

An apparatus which controls the parameters in a processing station of an electrophotographic printing machine having a photoconductive member. A test patch having a half tone image is recorded on the photoconductive member. The test patch is developed with developer material to form a developed half tone image on the photoconductive member. In response to the average density of the developed half tone image on the photoconductive member, the parameters of the processing station are regulated.

8 Claims, 2 Drawing Sheets

PROCESS CONTROL BY CREATING AND SENSING HALF-TONE TEST PATCHES

This invention relates generally to an electrophotographic printing machine, and more particularly concerns an apparatus for controlling parameters in a processing station.

In a typical electrophotographic printing process, a photoconductive member is charged to a substantially uniform potential so as to sensitize the surface thereof. The charged portion of the photoconductive member is exposed to a light image of an original document being reproduced. Alternatively, a raster output scanner generating a modulated light beam, i.e. a laser beam, may be used to discharge selected portions of the charged photoconductive surface to record the desired information thereon. In this way, exposure of the charged photoconductive member selectively dissipates the charge in the irradiated areas to record an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. While a dry developer material has been described, one skilled in the art will appreciate that a liquid developer material may be used instead of a dry developer material. The term developer used hereinafter is intended to include both a liquid developer material and a dry developer material, unless specifically stated otherwise.

It is generally well know to control and adjust particular parameters of an electrophotographic printing machine. For example, individual control signals can be used to adjust operating elements of a printing machine, such as controlling development by control of the ratio of toner particles to carrier granules in the developer material and the electrical bias applied to the developer roller. Other control techniques compare a signal measuring the reflected light from a clean photoconductive member to a signal reflected from a developed test patch formed thereon. The resultant error signal regulates toner dispensing to control the concentration of toner particles in the developer material. In this type of system, the test patch is developed to form a solid area of developer material on the photoconductive surface. Generally, the density of the developer material developed on the test patch is monitored by an infrared densitometer. The density of the developed test patch is designed to be in an intermediate the region i.e. of about 0.5 milligrams per centimeter$^2$. The densitometer is reasonably sensitive in this region and, sometimes, to minimize the load placed on the cleaning system of the printing machine. However, if the development system of the printing machine is over developing the image, the test patch will be a high density solid area. When the test patch is a high density solid area, the signal from the densitometer has greater uncertainty which increases and unacceptably widens the control band in printing machines striving for higher quality and reliability. This is due to the reduced sensitivity of the densitometer for test patches having high density solid area. For example, there is little or no change in the intensity of light reflected from a solid area test patch having a density of 1.0 milligrams per centimeter$^2$ and a solid area test patch having a density of 1.5 milligrams per centimeter$^2$. Thus, it is desirable to be able to measure all test patch development conditions, including over developed conditions, with sufficient sensitivity. The following disclosures appear to be relevant:

U.S. Pat. No. 4,544,263; Patentee: Sasaki et al.; Issued: Oct. 1, 1985.

U.S. Pat. No. 4,560,997; Patentee: Sato et al.; Issued Dec. 24, 1985.

U.S. Pat. No. 4,604,654; Patentee: Sakurada et al.; Issued: Aug. 5, 1986.

U.S. Pat. No. 4,693,592; Patentee: Kurpan; Issued: Sept. 5, 1987.

The relevant portions of the foregoing patents may be summarized as follows:

U.S. Pat. No. 4,544,263 discloses circuitry, responsive to light reflected from an original document being copied, for detecting the width of the lines of the original document. A compensation signal, based upon the output from the detecting circuitry, is used to control copy image density.

U.S. Pat. No. 4,560,997 and U.S. Pat. No. 4,604,654 disclose the formation of a pattern of ink dots by an ink jet printer. The gradient level of the pattern of ink dots is controlled by regulating the size of the ink dots and the forming the ink dots at equal intervals.

U.S. Pat. No. 4,693,592 discloses a test patch generator for an electrophotographic printing machine. A signal corresponding to the exposure level modified by a factor selected in accordance with the exposure setting, is used to control the the exposure level of the charged portion of the photoconductive member to record a latent image test patch thereon. The test patch is developed and the intensity of light reflected from the developed test patch is sensed and used to adjust the process parameters of the printing machine.

In accordance with one aspect of the present invention, there is provided an apparatus for controlling parameters in a processing station of a reproducing machine having an image receiving member. The apparatus includes means for recording a test patch comprising a half tone image on the image receiving member. Means develop the test patch with developer material to form a developed half-tone image on the image receiving member. Means, responsive to the average density of the developed half-tone image on the image receiving member, regulate the parameters of the processing station.

Pursuant to another aspect of the features of the present invention, there is provided an electrophotographic printing machine of the type having a photoconductive member and a plurality of processing stations associated therewith. The improvement includes means for recording a test patch comprising a half tone image on the photoconductive member. Means are provided for developing the test patch with developer material to form a developed half-tone image on the photoconductive member. Means, responsive to the average density of the developed half-tone image on the photoconductive member, regulate the parameters of the processing station.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
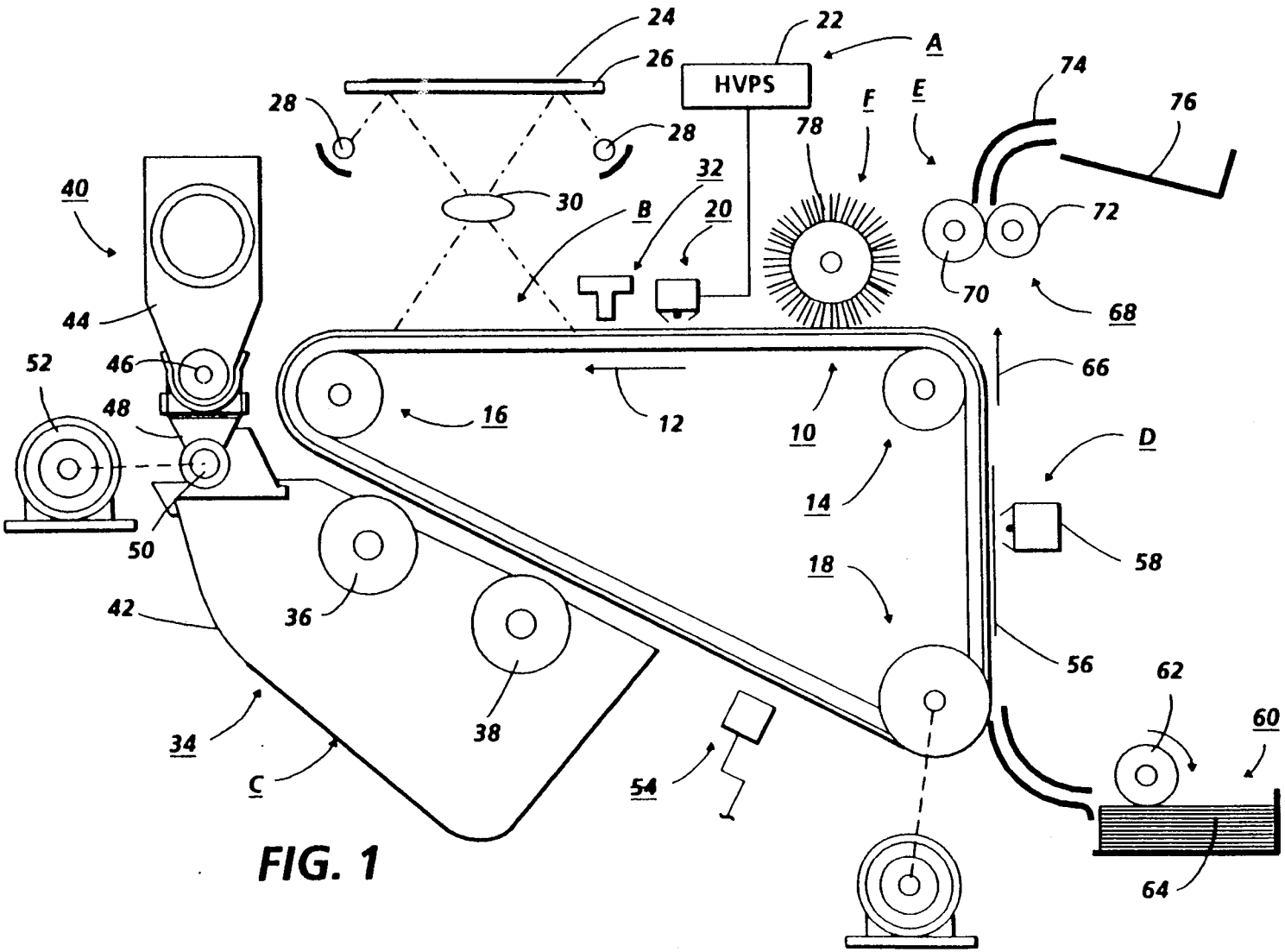
FIG. 1 is a schematic elevational view depicting an illustrative electrophotographic printing machine incorporating the features of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the present invention may be employed in a wide variety of printing machines and is not specifically limited in its application to the particular embodiment depicted herein.

Referring to FIG. 1 of the drawings, the electrophotographic printing machine employs a photoconductive belt 10. Preferably, the photoconductive belt 10 is made from a photoconductive material coated on a ground layer, which, in turn, is coated on a anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, and drive roller 18. Stripping roller 14 is mounted rotatably so as to rotate with belt 10. Tensioning roller 16 is resiliently urged against belt 10 to maintain belt 10 under the desired tension. Drive roller 18 is rotated by a motor coupled thereto by suitable means such as a belt drive. As roller 18 rotates, it advances belt 10 in the direction of arrow 12.

Initially, a portion of the photoconductive surface passes through charging station A. At charging station A, a corona generating device, indicated generally by the reference numeral 20, charges the photoconductive belt 10 to a relatively high, substantially uniform potential. Corona generating device 20 includes a generally U-shaped shield and a charging electrode. A high voltage power supply 22 is coupled to the shield A change in the output of power supply 22 causes corona generating device 20 to vary the charge applied to the photoconductive belt 10. Charging station A may be one of the processing stations regulated by the control system depicted in FIG. 2.

Next, the charged portion of the photoconductive surface is advanced through imaging station B. At imaging station B, an original document 24 is positioned face down upon a transparent platen 26. Imaging of a document is achieved by lamps 28 which illuminate the document on platen 26. Light rays reflected from the document are transmitted through lens 30. Lens 30 focuses the light image of the original document onto the charged portion of photoconductive belt 10 to selectively dissipate the charge thereon. This records an electrostatic latent image on the photoconductive belt which corresponds to the informational areas contained within the original document.

Imaging station B includes a test area generator, indicated generally by the reference numeral 32. Test generator 32 comprises a light source and a screen. The light rays are transmitted through the screen onto the charged portion of photoconductive belt 10, in the interimage region, i.e. between successive electrostatic latent images recorded on photoconductive belt 10. The screen modulates the light rays from the light source to record a halftone test patch on the photoconductive belt. The test patch recorded on photoconductive belt 10 is a square approximately 5 centimeters by 5 centimeters. The screen may be a pattern of dots or a pattern of spaced lines. One skilled in the art will appreciate that a raster output scanner (ROS) may be used in lieu of a light source and screen The ROS uses a laser whose beam is modulated. The modulated light beam is directed onto the charged region of the photoconductive belt 10, in the interimage region, to selectively dissipate the charge thereon. The laser beam is pulsed to generate a line pattern. For example, a 300 spot/inch ROS can generate a 150 line/inch halftone test patch.

One skilled in the art will appreciate that the light source and screen or ROS may be arranged to record a half tone test patch on photoconductive belt 10 in the interimage region. The electrostatic latent image and test patch are then developed with toner particles at development station C. In this way, a toner powder image and a developed half tone test patch is formed on photoconductive belt 10 The developed half tone test patch is subsequently examined to determine the quality of the toner image being developed on the photoconductive belt.

At development station C, a magnetic brush development system, indicated generally by the reference numeral 34, advances a developer material into contact with the electrostatic latent image and test patch recorded on photoconductive belt 10. Preferably, magnetic brush development system 34 includes two magnetic brush developer rollers 36 and 38. These rollers each advance the developer material into contact with the latent image and test areas. Each developer roller forms a brush comprising carrier granules and toner particles. The latent image and test patch attract the toner particles from the carrier granules forming a toner powder image on the latent image and a developed half tone test patch. As toner particles are depleted from the developer material, a toner particle dispenser, indicated generally by the reference numeral 40, furnishes additional toner particles to housing 42 for subsequent use by developer rollers 36 and 38, respectively. Toner dispenser 40 includes a container 44 storing a supply of toner particles therein. A foam roller 46 disposed in sump 48 coupled to container 44 dispenses toner particles into an auger 50. Auger 50 is made from a helical spring mounted in a tube having a plurality of apertures therein. Motor 52 rotates the helical spring to advance the toner particles through the tube so that toner particles are dispensed from the apertures therein. This process station may also be controlled by the control system of the present invention by regulating the energization of motor 52.

Figure 2:
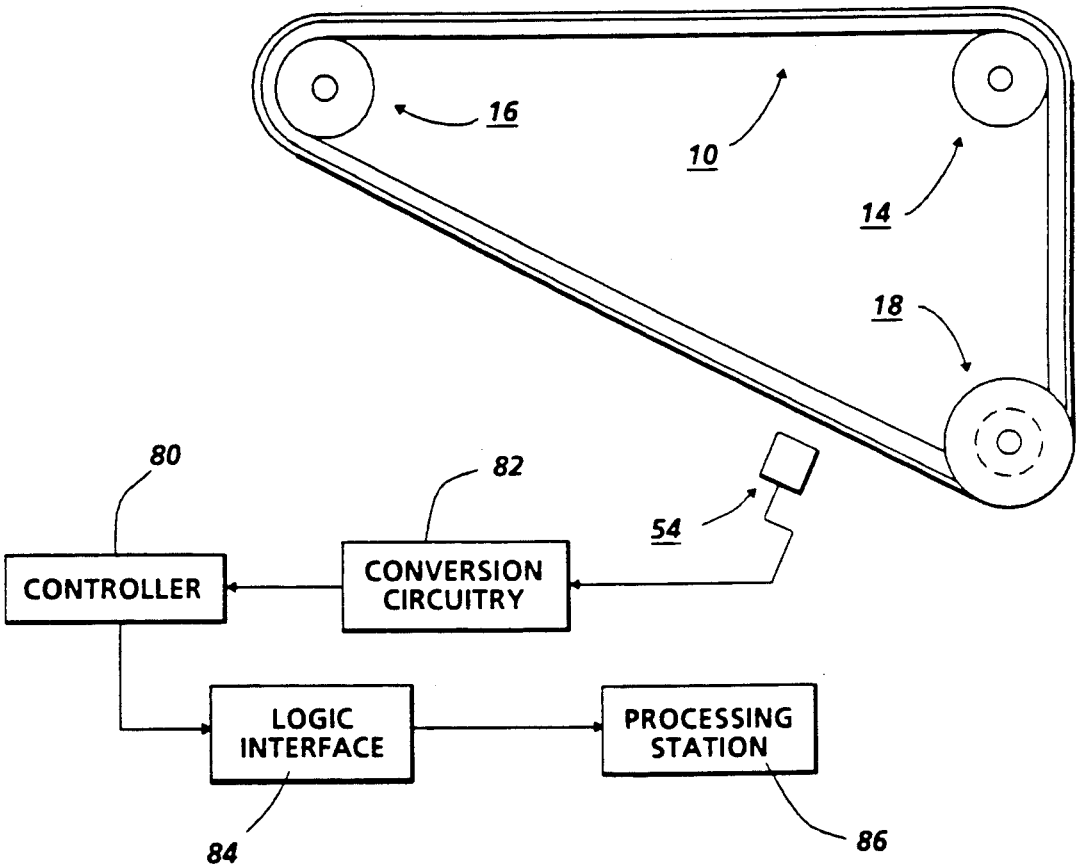
FIG. 2 is a schematic elevational view showing the control system used in the FIG. 1 printing machine.

A densitometer 54, positioned adjacent the photoconductive belt between developer station C and transfer station D, generates electrical signals proportional to the developed half tone test patch. These signals are conveyed to a control system and suitably processed for regulating the processing stations of the printing machine. Further details of the control system are shown in FIG. 2 and will be described hereinafter with reference thereto. Preferably, densitometer 54 is an infrared densitometer. The infrared densitometer is energized at 15 volts DC and about 50 milliamps. The surface of the infrared densitometer is about 7 millimeters from the surface of photoconductive belt 10. Densitometer 54 includes a semiconductor light emitting diode having a 940 nanometer peak output wavelength with a 60 nanometer one-half power bandwidth. The power output is approximately 45 milliwatts. A photodiode receives the light rays reflected from the developed half tone test patch and converts the measured light ray input to an electrical output signal. The infrared densitometer is also used to periodically measure the light rays reflected from the bare photoconductive surface, i.e. without developed toner particles, to provide a reference level for calculation of the signal ratio. After development, the toner powder image is advanced to transfer station D.

At transfer station D, a copy sheet 56 is moved into contact with the toner powder image. The copy sheet is advanced to transfer station D by a sheet feeding apparatus 60. Preferably, sheet feeding apparatus 60 includes a feed roll 62 contacting the uppermost sheet of a stack 64 of sheets. Feed rolls 62 rotate so as to advance the uppermost sheet from stack 64 into chute. Chute guides the advancing sheet from stack 64 into contact with the photoconductive belt in a timed sequence so that the toner powder image developed thereon contacts the advancing sheet at transfer station D. At transfer station D, a corona generating device 58 sprays ions onto the backside of sheet 56. This attracts the toner powder image from photoconductive belt 10 to copy sheet 56. After transfer, the copy sheet is separated from belt 10 and a conveyor advances the copy sheet, in the direction of arrow 66, to fusing station E.

Fusing station E includes a fuser assembly, indicated generally by the reference numeral 68 which permanently affixes the transferred toner powder image to the copy sheet. Preferably, fuser assembly 68 includes a heated fuser roller 70 and a pressure roller 72 with the powder image on the copy sheet contacting fuser roller 70. In this manner, the toner powder image is permanently affixed to sheet 56. After fusing, chute 74, guides the advancing sheet 56 to catch tray 76 for subsequent removal from the printing machine by the operator.

After the copy sheet is separated from photoconductive belt 10, the residual toner particles and the toner particles adhering to the test patch are cleaned from photoconductive belt 10. These particles are removed from photoconductive belt 10 at cleaning station F. Cleaning station F includes a rotatably mounted fiberous brush 78 in contact with photoconductive belt 10. The particles are cleaned from photoconductive belt 10 by the rotation of brush 78. Subsequent to cleaning, a discharge lamp (not shown) floods photoconductive belt 10 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Referring now to FIG. 2, the details of the control system are shown therat. As illustrated in FIG. 2, infrared densitometer 54 detects the density of the developed test patch and produces an electrical output signal indicative thereof. The theoretical sensitivity of the densitometer output as a function of the half tone test patch may be estimated by holding all other parameters constant so that an increment in the solid area developability increases the area of a half tone dot by a fixed amount regardless of the frequency. By this approximation, low frequency dots are less sensitive to developability changes than the high frequency half tones.

The half tone pattern is assumed to be a simple square. In the region of interest, the dot area, A, is expressed as:

$$A=b/f^2+c(M-M_0)/f$$

where b and c are constants, and M and $M_0$ are the developed toner mass per unit of solid area, $M_0$ being developed mass at the operating point, and f is the frequency of the half tone pattern. The fraction e of the area covered by developed toner may be expressed as:

$$e=b+c(M-M_0)f$$

The amount of the light reflected by a unit area consists of a weak contribution from the developed fraction $el_d$ and the contibution for the undeveloped area is $(1-e)l_p$, for a total of $$l=el_d+(1-e)l_p$$

where $l_d$ and $l_p$ are the light intensities reflected from a unit area of developed and a clean, undeveloped, photoconductive surface, respectively. The slope of the line l versus M is a measure of the sensitivity of this method and may be expressed as $$(dl/de)(de/dM)=(l_d-l_p)cf.$$

Due to the form of the simplifying assumption, the higher the frequency, the higher the sensitivity. However, practical limitations to the frequency are apparent. The upper limit is the highest frequency that the ROS can deliver and the frequency has to be low enough to allow reproducible developability of a relatively small test patch. Once the constraints are determined experimentally, this model can be used in determining developability or toner concentration control and process latitude in the vicinity of the operating point.

The following table compares the experimental results obtained when the test patch is a half tone test patch versus a solid area test patch.

| Toner Concentration (%) | 2.6 | 3.0 | 3.5 | 4.3 |
|---|---|---|---|---|
| Test Patch Solid | 1.30 | 1.34 | 1.35 | 1.37 |

-continued

| Toner Concentration (%) | 2.6 | 3.0 | 3.5 | 4.3 |
|---|---|---|---|---|
| Area Density Test Patch Half Tone Density | 0.49 | 0.53 | 0.58 | 0.64 |
| Half Tone Light Intensity Ratio (%) | 1.00 | 1.10 | 1.23 | 1.41 |
| Solid Area Light Intensity Ratio (%) | 1.00 | | | 1.17 |

The electrical signal produced by the infrared densitometer is proportional to the change of reflected light intensity which is related to the change in density exponentially. The change in solid area density over the range of toner concentration shown in the table is 0.07. This corresponds to a change in detected light intensity of 17%, (1.17% − 1.00%). The change in half tone density over the range of toner concentration is 0.15 which corresponds to a change in detected light intensity of 41%. Thus, there is a 24% increase in sensitivity by using a half tone test patch rather than a solid area test patch. The half tone test patch used to obtain these experimental results was generated by alternating two pixels on and two pixels off by a 300 spot/inch ROS.

With continued reference to FIG. 2, infrared densitometer 54 detects the density of the developed half tone test patch and produces electrical output signals indicative thereof. Thus, infrared densitometer 54 generates an electrical output signal proportional to the mass of the half tone developed image. In addition, an electrical output signal is periodically generated by infrared densitometer 54 corresponding to the bare or undeveloped photoconductive surface. These signals are conveyed to controller 80 through suitable conversion circuitry 82. Controller 80 forms the ratio of the developed test patch signal/bare photoconductive surface signal and generates electrical error signals proportional thereto. The error signal is transmitted to logic interface 84 which processes the error signal so that it controls the respective processing station 86. For example, if the charging station is the processing station being controlled, the logic interface transmits the error signal in the appropriate form to the high voltage power supply to regulate charging of the photoconductive surface. When toner concentration is being controlled, motor 52 (FIG. 1) is energized causing toner dispenser 40 to discharge toner particles into developer housing 42. This increases the concentration of toner particles in the developer mixture. During operation of the electrophotographic printing machine, any of the selected processing stations can be simultaneously controlled by the control loop depicted in FIG. 2. For example, in addition to controlling charging and toner concentration, the electrical bias applied to the developer roller may also be regulated. By regulating a plurality of processing stations, larger variations from the nominal conditions and faster returns to the nominal conditions are possible. Thus, the various printing machine processing stations have wider latitude.

Figure 3:
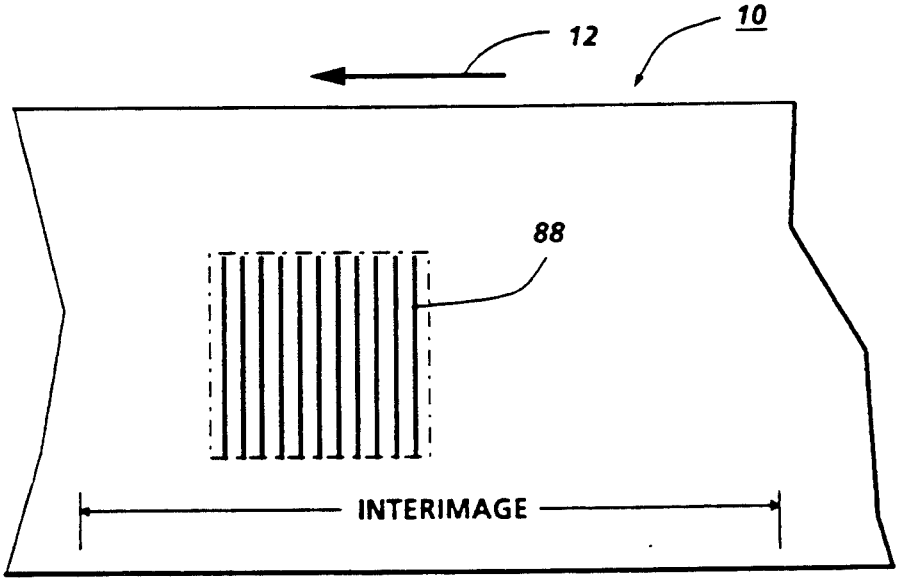
FIG. 3 shows a half-tone test patch formed in the interimage region on the photoconductive belt of the FIG. 1 printing machine.

Referring now to FIG. 3, there is shown an exemplary test patch 88 recorded in the interimage region of photoconductive belt 10. The test patch is a square about 5 centimeters by 5 centimeters and includes a plurality of equally spaced lines. As previous noted, the lines are formed by turning a 300 spot per inch ROS on for two pixels and off for two pixels. This records a half tone test patch on the photoconductive belt. As the photoconductive belt advances in the direction of arrow 12, the half tone test patch passes through the development station. At the development station, the lines of the test patch are developed so as to form a developed half tone test patch. Infrared densitometer 54 (FIG. 2) detects the density of the developed half tone test patch and generates an electrical signal which is processed to form an error signal used to control the parameters of one or more of the various processing stations of the printing machine.

In recapitulation, the printing machine of the present invention employs an apparatus for controlling the parameters of the processing stations thereof by recording a test patch on the photoconductive surface. The test patch is a half tone image. The sensitivity of the control system is increased by utilizing a half tone image as opposed to a solid area image.

It is, therefore, evident that there has been provided, in accordance with the present invention, a printing machine that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

I claim:

1. An electrophotographic printing machine of the type having a photoconductive member and a plurality of processing stations, wherein the improvement includes:

means for recording a test patch having a half tone image on the photoconductive member, said recording means comprising means for charging a portion of the photoconductive member, means for illuminating a selected region of the charged portion of the photoconductive member with a laser beam, and means for modulating the laser beam to record the test patch having the half tone image on the photoconductive member;

means for developing the test patch with developer material to form a developed half-tone image on the photoconductive member; and means, responsive to the average density of the developed half-tone image on the photoconductive member, for regulating the parameters of the processing stations.

2. A printing machine according to claim 1, wherein the test patch recorded on the photoconductive member by said recording means includes a plurality of spaced lines.

3. A printing machine according to claim 1, wherein the test patch recorded on the photoconductive member by said recording means includes a plurality of spaced dots.

4. A printing machine according to claim 1, wherein said regulating means includes a densitometer for measuring the average density of the developed half tone image of the test patch and generating a signal corresponding thereto.

5. A printing machine according to claim 4, wherein said regulating means includes means, responsive to the signal from said densitometer, for indicating periodically that the average density of the developed half tone image of the test patch deviates from a reference condition and generating an error signal corresponding to the deviation thereof.

6. A printing machine according to claim 5, wherein the error signal from said indicating means regulates the processing station dispensing developer material to a developer unit.

7. A printing machine according to claim 5, wherein the error signal from said indicating means regulates the processing station charging the photoconductive member.

8. A printing machine according to claim 5, wherein the error signal from said indicating means regulates the processing station electrically biasing a developer roll of a developer unit.

* * * * *